US009332354B2

(12) United States Patent
Conti et al.

(10) Patent No.: US 9,332,354 B2
(45) Date of Patent: May 3, 2016

(54) MICROMECHANICAL DETECTION STRUCTURE FOR A MEMS ACOUSTIC TRANSDUCER AND CORRESPONDING MANUFACTURING PROCESS

(71) Applicant: STMicroelectronics S.r.l., Agrate Brianza (IT)

(72) Inventors: Sebastiano Conti, Mistretta (IT); Marco Salina, Cremosano (IT); Luca Lamagna, Cassina de'Pecchi (IT); Matteo Perletti, Vaprio d'Adda (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 105 days.

(21) Appl. No.: 14/254,511

(22) Filed: Apr. 16, 2014

(65) Prior Publication Data

US 2014/0314254 A1 Oct. 23, 2014

(30) Foreign Application Priority Data

Apr. 18, 2013 (IT) ..... TO2013A0313

(51) Int. Cl.

| | |
|---|---|
| ***H04R 25/00*** | (2006.01) |
| ***H04R 23/00*** | (2006.01) |
| ***H04R 19/00*** | (2006.01) |
| ***H04R 19/04*** | (2006.01) |
| ***H04R 31/00*** | (2006.01) |

(52) U.S. Cl.

CPC ..... *H04R 23/00* (2013.01); *H04R 19/005* (2013.01); *H04R 19/04* (2013.01); *H04R 31/00* (2013.01); *Y10T 29/49005* (2015.01)

(58) Field of Classification Search

CPC .... H01H 59/0009; H01L 29/84; H01L 29/00; H04R 1/0257; H04R 19/00; H04R 19/04; H04R 19/005; H04R 19/016; H04R 23/006; H04R 25/00; B81B 2201/0235; B81B 2203/0118; B81B 2203/0127; G01P 15/0802; G01P 15/124

USPC ..... 381/174, 175; 257/254, 415, 416

See application file for complete search history.

(56) References Cited

U.S. PATENT DOCUMENTS

| | | | | |
|---|---|---|---|---|
| 7,620,192 | B2 * | 11/2009 | Yamaoka | H01G 5/0136 381/174 |
| 8,036,401 | B2 * | 10/2011 | Poulsen | H04R 19/005 381/174 |
| 2010/0158279 | A1 | 6/2010 | Conti et al. | |

FOREIGN PATENT DOCUMENTS

| | | | |
|---|---|---|---|
| JP | 2007 267049 | A | 10/2007 |
| JP | 2007 267252 | A | 10/2007 |
| KR | 10 2008 0087172 | A | 9/2008 |

* cited by examiner

*Primary Examiner* — Brian Ensey

(74) *Attorney, Agent, or Firm* — Seed IP Law Group PLLC

(57) ABSTRACT

A micromechanical structure for a MEMS capacitive acoustic transducer, has: a substrate made of semiconductor material, having a front surface lying in a horizontal plane; a membrane, coupled to the substrate and designed to undergo deformation in the presence of incident acoustic-pressure waves; a fixed electrode, which is rigid with respect to the acoustic-pressure waves and is coupled to the substrate by means of an anchorage structure, in a suspended position facing the membrane to form a detection capacitor. The anchorage structure has at least one pillar element, which is at least in part distinct from the fixed electrode and supports the fixed electrode in a position parallel to the horizontal plane.

22 Claims, 6 Drawing Sheets

MICROMECHANICAL DETECTION STRUCTURE FOR A MEMS ACOUSTIC TRANSDUCER AND CORRESPONDING MANUFACTURING PROCESS

BACKGROUND

1. Technical Field

The present disclosure relates to an improved micromechanical detection structure for a MEMS (Micro-Electro-Mechanical Systems) acoustic transducer, in particular a microphone of a capacitive type, and to a corresponding manufacturing process.

2. Description of the Related Art

As is known, a MEMS acoustic transducer of a capacitive type generally comprises a mobile electrode, provided as a diaphragm or membrane, set facing a substantially fixed electrode so as to form the plates of a detection capacitor.

The mobile electrode is generally anchored, by means of a perimetral portion thereof, to a substrate, whereas a central portion is free to move or bend in response to acoustic-pressure waves impinging upon one of its surfaces. The mobile electrode and the fixed electrode provide a detection capacitor, and bending of the membrane that constitutes the mobile electrode causes a variation of capacitance of this detection capacitor. During operation, the variation of capacitance is converted, by suitable processing electronics, into an electrical signal, which is supplied as an output signal of the MEMS acoustic transducer.

A MEMS acoustic transducer of a known type is, for example, described in detail in US patent application No. 2010/0158279 A1 (which is incorporated by reference herein), filed in the name of the present Applicant.

FIG. 1 shows by way of example, and in a simplified manner, a portion of the micromechanical detection structure of the acoustic transducer, designated as a whole by 1.

The micromechanical structure 1 comprises a substrate 2 made of semiconductor material, and a mobile membrane (or diaphragm) 3. The membrane 3 is made of conductive material and faces a fixed electrode or rigid plate 4, generally known as "back plate", which is rigid, at least when compared to the membrane 2, which is instead flexible and undergoes deformation as a function of incident acoustic-pressure waves.

Membrane 3 is anchored to substrate 2 by means of membrane anchorages 5, formed by protuberances of the same membrane 3, which extend from peripheral regions thereof towards the substrate 2.

For instance, membrane 3 has in a top plan view, i.e., in a horizontal plane of main extension, a substantially square shape, and the membrane anchorages 5, which are four in number, are set at the vertices of the square.

The membrane anchorages 5 perform the function of suspending the membrane 3 above the substrate 2, at a certain distance therefrom. The value of this distance is a function of a compromise between the linearity of response at low frequencies and the noise of the acoustic transducer.

In order to enable relief of the residual stresses (tensile and/or compressive stresses) on the membrane 3, for example deriving from the manufacturing process, through openings (not illustrated herein) may be formed through the membrane 3, in particular in the proximity of each membrane anchorage 5, in order to "equalize" the static pressure present on the surfaces of the same membrane 3.

The rigid plate 4 is formed by a first plate layer 4*a*, made of conductive material and facing the membrane 3, and by a second plate layer 4*b*, made of insulating material.

The first plate layer 4*a* forms, together with the membrane 3, the detection capacitor of the micromechanical structure 1.

In particular, the second plate layer 4*b* is set on the first plate layer 4*a*, except for portions in which it extends through the first plate layer 4*a* so as to form bumps 6 of the rigid plate 4, which extend as far as the underlying membrane 3 and have the function of preventing adhesion of the membrane 3 to the rigid plate 4, as well as of limiting the oscillations of the same membrane 3.

For instance, the thickness of the membrane 3 is in the range 0.3-1.5 μm, for example equal to 0.7 μm; the thickness of the first plate layer 4*a* is in the range 0.5-2 μm, for example equal to 0.9 μm; and the thickness of the second plate layer 4*b* is in the range 0.7-2 μm, for example equal to 1.2 μm.

The rigid plate 4 moreover has a plurality of holes 7, which extend through the first and second plate layers 4*a*, 4*b*, have, for example, a circular cross section, and perform the function of allowing, during the manufacturing steps, removal of underlying sacrificial layers. Holes 7 are, for example, set so as to form a lattice, in a horizontal plane, parallel to the substrate. Furthermore, in use, the holes 7 enable free circulation of air between the rigid plate 4 and the membrane 3, making the rigid plate 4 acoustically transparent. Holes 7 hence act as acoustic access ports in order to enable the acoustic-pressure waves to reach and deform the membrane 3.

The rigid plate 4 is anchored to the substrate 2 by means of plate anchorages 8, which are connected to peripheral regions of the same rigid plate 4.

In particular, plate anchorages 8 are formed by vertical pillars (i.e., extending in a direction orthogonal to the horizontal plane and to the substrate), which are made of the same conductive material as the first plate layer 4*a* and hence form a single piece with the rigid plate 4. In other words, the first plate layer 4*a* has prolongations that extend as far as the substrate 2 to define the anchorages of the rigid plate 4.

The membrane 3 is moreover suspended and directly faces a first cavity 9*a*, formed through the substrate 2, by means of a through trench etched starting from a back surface 2*b* of the substrate 2, which is opposite to a front surface 2*a* thereof, on which the membrane anchorages 5 rest (the first cavity 9*a* hence defines a through hole that extends between the front surface 2*a* and the back surface 2*b* of the substrate 2). In particular, the front surface 2*a* lies in the horizontal plane.

The first cavity 9*a* is also known as "back chamber", in the case where the acoustic-pressure waves impinge first upon the rigid plate 4 and then upon the membrane 3. In this case, the front chamber is formed by a second cavity 9*b*, which is delimited at the top and at the bottom, respectively, by the first plate layer 4*a* and by the membrane 3.

Alternatively, it is in any case possible for the pressure waves to reach the membrane 3 through the first cavity 9*a*, which in this case performs the function of acoustic access port, and, hence, of front chamber.

In greater detail, the membrane 3 has a first surface 3*a* and a second surface 3*b*, which are opposite to one another and face, respectively, the first cavity 9*a* and the second cavity 9*b*, to be in fluid communication, respectively, with the back chamber and with the front chamber of the acoustic transducer.

Furthermore, the first cavity 9*a* is formed by two cavity portions 9*a*', 9*a*': a first cavity portion 9*a*' is set at the front surface 2*a* of the substrate 2 and has a first extension in the horizontal plane; the second cavity portion 9*a*' is set at the back surface 2*b* of the substrate 2 and has a second extension in the horizontal plane, greater than the first extension.

In a known way, the sensitivity of the acoustic transducer depends on the mechanical characteristics of the membrane 3, as well as on the assembly of the membrane 3 and of the rigid plate 4.

Furthermore, the performance of the acoustic transducer depends on the volume of the back chamber and the volume of the front chamber. In particular, the volume of the front chamber determines the upper resonance frequency of the acoustic transducer, and hence its performance at high frequencies. In general, indeed, the smaller the volume of the front chamber, the higher the upper cut-off frequency of the acoustic transducer. Furthermore, a large volume of the back chamber enables improvement of the frequency response and the sensitivity of the same acoustic transducer.

The present Applicant has found that the micromechanical structure 1 of a known type described previously is subject to some drawbacks, related in particular to manufacturing of the rigid plate 4 and to its anchorage to the substrate 2.

In particular, it is known that in a capacitive microphone the rigid plate (or reference plate) should be as planar as possible (given that it forms the reference plate of the detection capacitor), and moreover as rigid as possible (in order to prevent movements correlated to the acoustic-pressure waves or other undesired movements).

However, in the micromechanical structure 1 described previously, the rigid plate 4 may undergo a bending stress, as shown by the curved arrow represented with a solid line in FIG. 1, on account of the conformation of the plate anchorages 8, in particular of the aspect ratio, and of the suspended arrangement above the membrane 3, as well as on account of the residual stresses in the constituent materials, which determine a force acting in the direction indicated by the dashed arrows.

The factors affecting the aforesaid residual stresses are multiple and are due, for example, to the properties of the materials used, to the techniques of deposition of the same materials, to the conditions (temperature, pressure, etc.) at which deposition is carried out, and to possible subsequent thermal treatments.

In other words, a sort of spring, or elastic element, is formed at the plate anchorages 8, i.e., at the vertical pillar portions of the rigid plate 4 towards the substrate 2.

On account of its mechanical deformation, the rigid plate 4 may have a lower stiffness and moreover may not be perfectly planar or horizontal, thus affecting, even significantly, the performance of the acoustic transducer, for example reducing its sensitivity.

Furthermore, from the standpoint of the manufacturing process of the micromechanical structure 1, it is evident that formation of the plate anchorages 8, given their conformation, requires a large thickness of a resist layer, during the step of lithographic definition (the so-called "patterning") of the last layers, or levels, of material.

In particular, this makes control of the manufacturing process problematical and moreover generates markedly vertical geometries, which may be particularly critical for chemical etchings (in particular, dry etches), considerably increasing the time required for execution of the same etchings.

BRIEF SUMMARY

According to one or more embodiments of the present disclosure, a micromechanical detection structure for a MEMS acoustic transducer, and a corresponding manufacturing process are provided.

One embodiment includes a micromechanical structure comprising a semiconductor substrate having a first surface and an anchorage structure including a plurality of pillar elements. The micromechanical structure further comprises a detection capacitor that includes a membrane coupled to said substrate. The membrane is configured to deform in response to acoustic-pressure waves. The detection capacitor further includes a fixed electrode that is rigid with respect to said acoustic-pressure waves and is coupled to said substrate by the anchorage structure. The anchorage structure is configured to support the fixed electrode in a suspended position facing said membrane.

BRIEF DESCRIPTION OF THE SEVERAL VIEWS OF THE DRAWINGS

For a better understanding of the present disclosure, preferred embodiments thereof are now described, purely by way of non-limiting example and with reference to the attached drawings, wherein.

DETAILED DESCRIPTION

As will be described in detail hereinafter, the general idea underlying the present disclosure envisages providing, during the manufacturing process of the micromechanical detection structure of the acoustic transducer, a supporting and anchoring structure for the rigid plate, distinct from the same rigid plate, such as to support the rigid plate and create an equivalent force that will reduce the bending stresses to which it is subjected on account of the residual stresses in the materials, and moreover such as to enable a reduction in the thickness of the resist layers required in the last process steps for definition of the same rigid plate.

Figure 1:
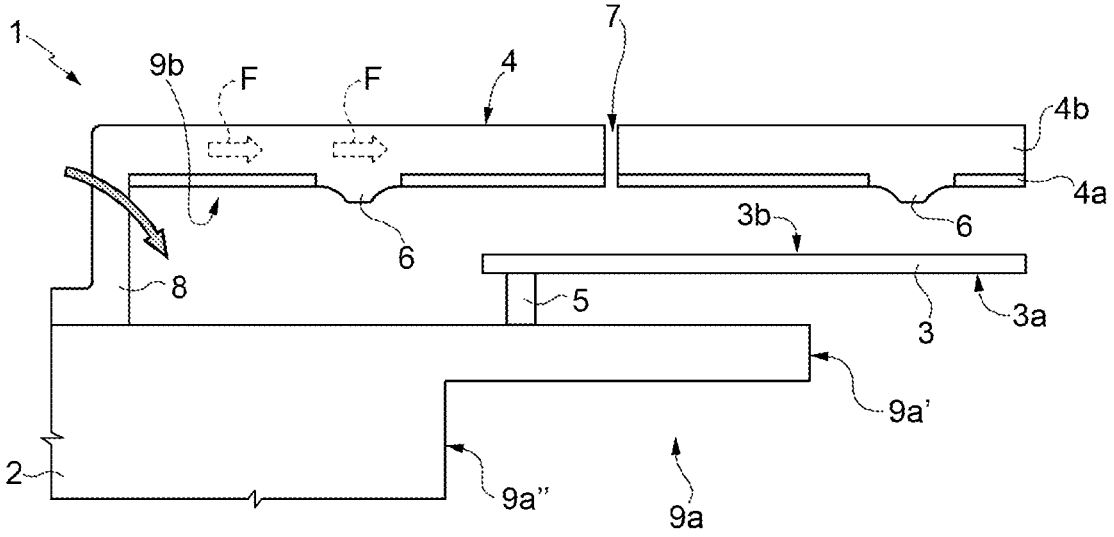
FIG. 1 (PRIOR ART)
FIG. 1 is a schematic representation in cross section of a portion of a micromechanical detection structure of a MEMS acoustic transducer of a known type.
Figure 2A:
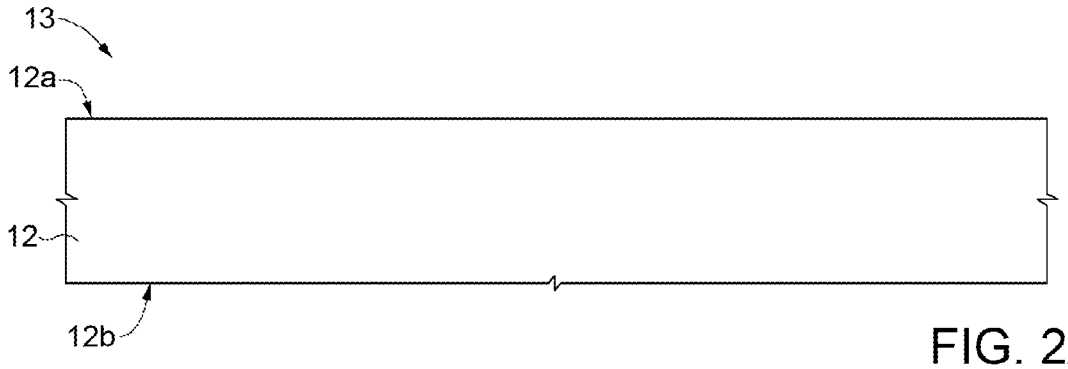
FIG. 2*a*-2*l* show sections of a micromechanical detection structure of a MEMS acoustic transducer according to an embodiment of the present disclosure, in successive steps of a corresponding manufacturing process.

The manufacturing process of a micromechanical detection structure for a MEMS acoustic transducer according to one aspect of the present solution is now described, with reference first to FIG. 2*a* (for reasons of illustration, FIG. 2*a*, as likewise the subsequent figures, are not drawn to scale; moreover, in what follows, same reference numbers will generally be used to designate elements that are similar to ones previously described with reference to FIG. 1).

In an initial step (FIG. 2*a*) a substrate 12 is provided in a wafer 13 of semiconductor material, in particular silicon, having a thickness between 400 μm and 800 μm, for example 725 μm; substrate 12 is subjected to a polishing step at the front and at the back, hence at a front surface 12*a* and a back surface 12*b* thereof.

Figure 2B:
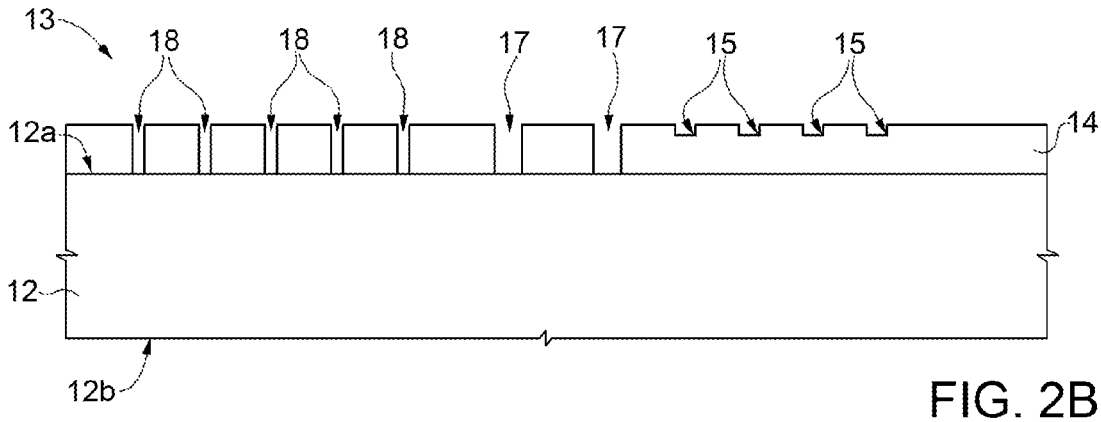

As illustrated in FIG. 2*b*, a first sacrificial layer 14, which is made, for example, of silicon oxide and has a thickness for example of 2.6 μm, is thermally deposited on the wafer 13 and subjected to a first chemical etching, for example a timed etching, for opening first anti-adhesion recesses 15. As will be described hereinafter, the first anti-adhesion recesses 15 have the function of molds, for formation of anti-adhesion elements (also referred to as "bumps") on the membrane of the micromechanical structure of the acoustic transducer. The first anti-adhesion recesses 15 may, for example, have a height in a vertical direction (i.e., orthogonal to a horizontal plane of main extension of the substrate 12) of 0.5 μm.

The first sacrificial layer 14 is subjected to a chemical etching with etch-stop on the silicon, such as to open membrane-anchorage openings 17 throughout the thickness of the first sacrificial layer 14, in desired positions (for example, at the vertices of what will be the square occupied in plan view by the membrane).

According to one aspect of the present solution, the mask used to execute the chemical etching for definition of the first sacrificial layer 14 is moreover configured for enabling formation, substantially at a same time, of first plate-anchorage openings 18, laterally shifted with respect to the membrane-anchorage openings 17, on the opposite side with respect to the first anti-adhesion recesses 15.

Figure 3:
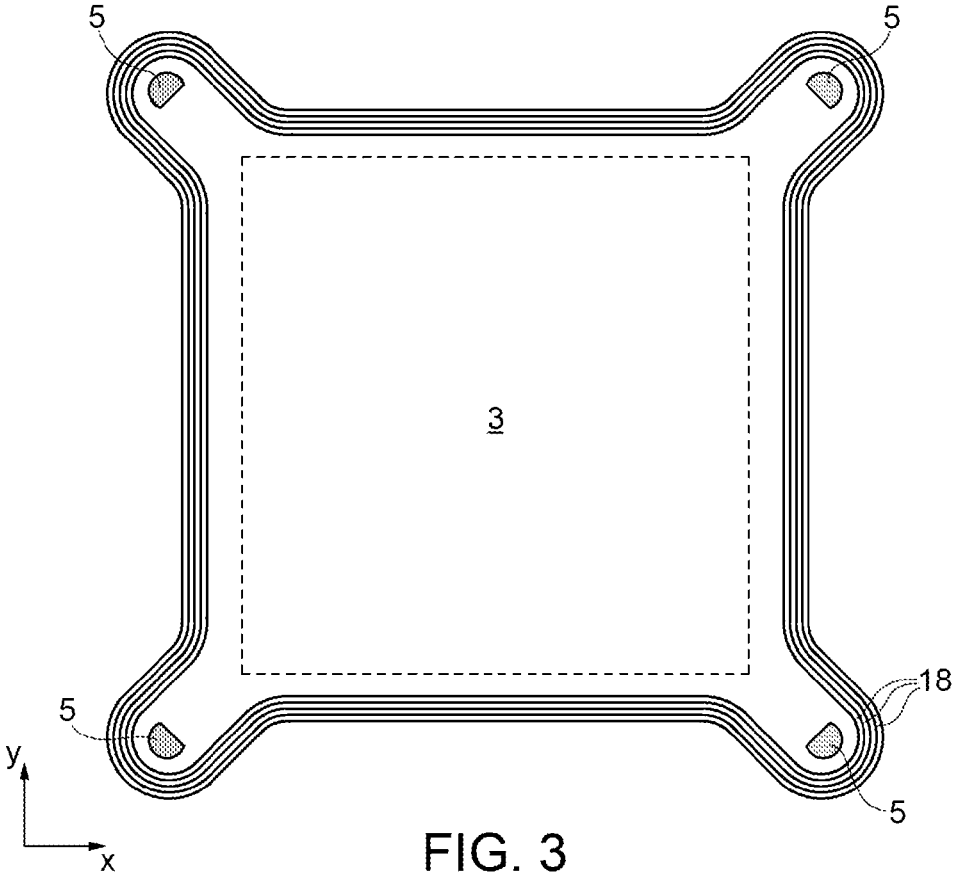
FIG. 3 is a schematic and simplified top plan view of part of the micromechanical detection structure.

As shown also in the schematic plan view of FIG. 3, the first plate-anchorage openings 18 are more than, or equal to, two in number (in the example, five) and are set laterally side-by-side in the horizontal plane, henceforth designated by xy. Furthermore, the first plate-anchorage openings 18 define in plan view a closed perimeter having a generically polygonal shape, designed to surround entirely the membrane of the micromechanical detection structure of the acoustic transducer.

The position of the membrane anchorages 5 is moreover shown in FIG. 3, which are set at the corners of the aforesaid closed perimeter, and the area occupied at the center by the membrane 3 is also represented with a dashed line.

Figure 2C:
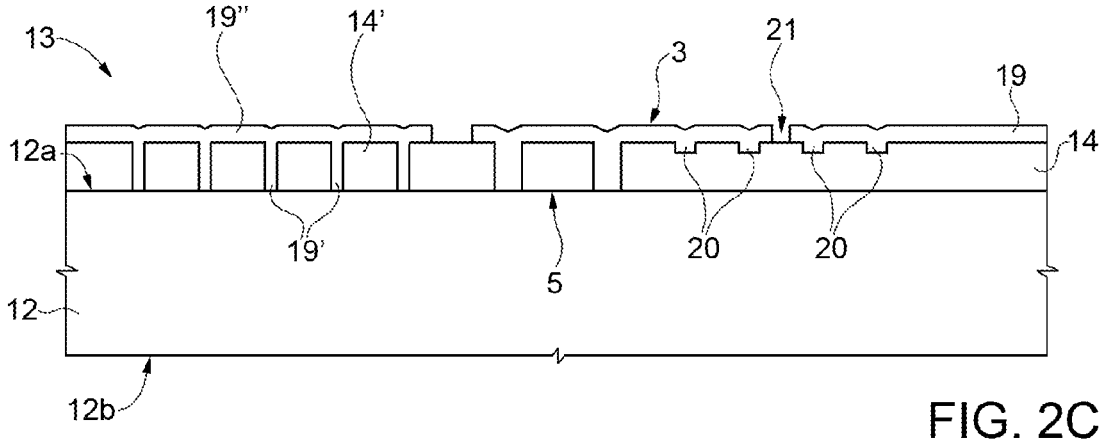

As shown in FIG. 2*c*, a first conductive layer 19 is deposited on the wafer 13, for example made of optimized polysilicon, having a thickness of between 0.3 μm and 1.5 μm, for example 0.75 μm, which coats the wafer 13 and fills in particular the anti-adhesion recesses 15, the membrane-anchorage openings 17, and the first plate-anchorage openings 18.

Accordingly, the membrane anchorages 5 are formed, as well as membrane anti-adhesion elements 20 (also referred to as "bumps"), designed to define protuberances of the membrane, once again designated by 3, in order to prevent adhesion thereof to the underlying substrate 12. In particular, membrane anchorages 5 comprise vertical portions of the first conductive layer 19 formed within the membrane-anchorage openings 17, in direct contact with the front surface 12*a* of the substrate 12, and a portion of the first sacrificial layer 14 between the same vertical portions.

In this process step, a bottom portion is moreover formed of what will become, at the end of the manufacturing process, the anchorage structure of the rigid plate of the acoustic transducer. In particular, this bottom portion comprises vertical portions 19' of the first conductive layer 19 formed within the plate-anchorage openings 18, in direct contact with the front surface 12*a* of the substrate 12, and portions 14' of the first sacrificial layer 14 between vertical portions 19' adjacent to, and overlaid by, horizontal portions 19" of the same first conductive layer 19 (which are joined to the aforesaid vertical portions 19').

As shown in the same FIG. 2*c*, the first conductive layer 19 is defined (i.e., selectively etched and removed) by means of lithography and chemical etching step, with etch-stop on the first sacrificial layer 14 in order to define the conformation of the membrane 3 (which may, for example, be square or generally polygonal in the horizontal plane xy). In particular, the membrane 3 is contained, in the horizontal plane xy, within the closed perimeter defined by the plate-anchorage structure.

After definition of the first conductive layer 19, also the horizontal portions 19" remain, arranged in the area of the plate-anchorage structure, whereas the remaining part of the first conductive layer 19 is removed.

In this etching step, one or more through openings 21 are moreover defined throughout the thickness of the membrane 3, which are aimed at equalizing the front and back surfaces of the membrane 3.

Figure 2D:
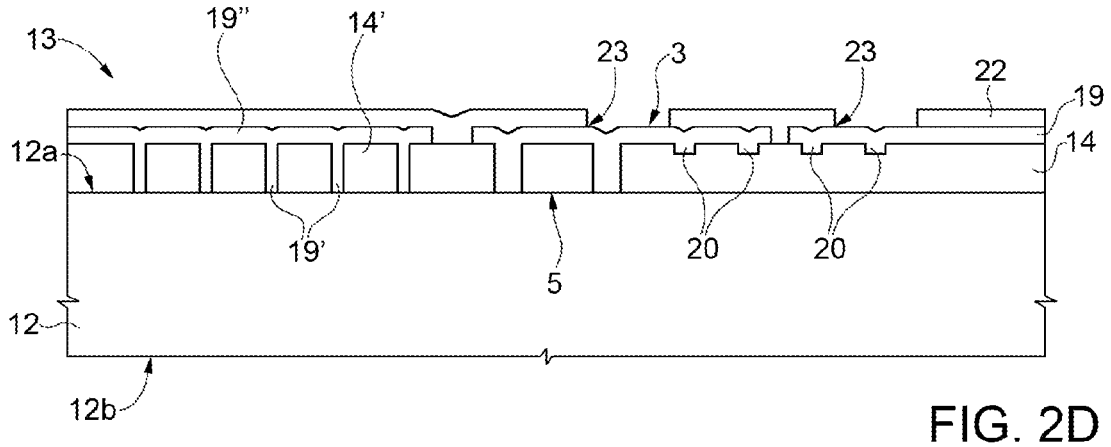

As shown in FIG. 2*d*, a second sacrificial layer 22, made, for example, of silicon oxide with a thickness of approximately 1.1 μm, is deposited on the wafer 13.

The second sacrificial layer 22 is then defined, for example etching with etch-stop on the first conductive layer 19, so as to form a plurality of anti-adhesion openings 23, which have the function of enabling, during subsequent steps of the manufacturing process, formation of anti-adhesion elements for the rigid plate of the micromechanical structure of the acoustic transducer.

Figure 2E:
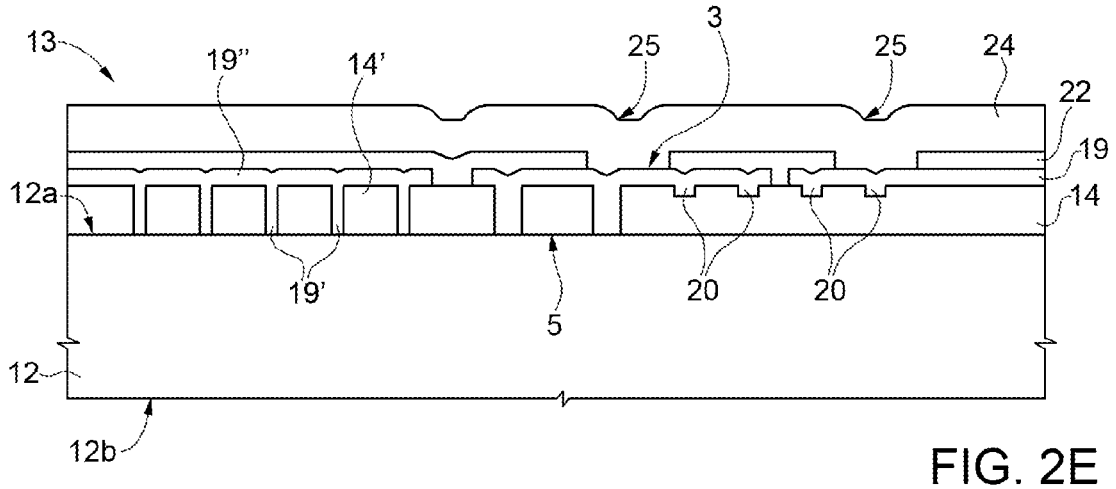

A third sacrificial layer 24 is then deposited on the wafer 13 (FIG. 2*e*), made for example of USG (undoped silicon glass), and having a thickness, for example, of 2 μm; the third sacrificial layer 24 in particular fills the second anti-adhesion openings 23, assuming a surface shape that follows, at least partially, the shape of the underlying second sacrificial layer 22, hence having depressions 25 at the second anti-adhesion openings 23.

Figure 2F:
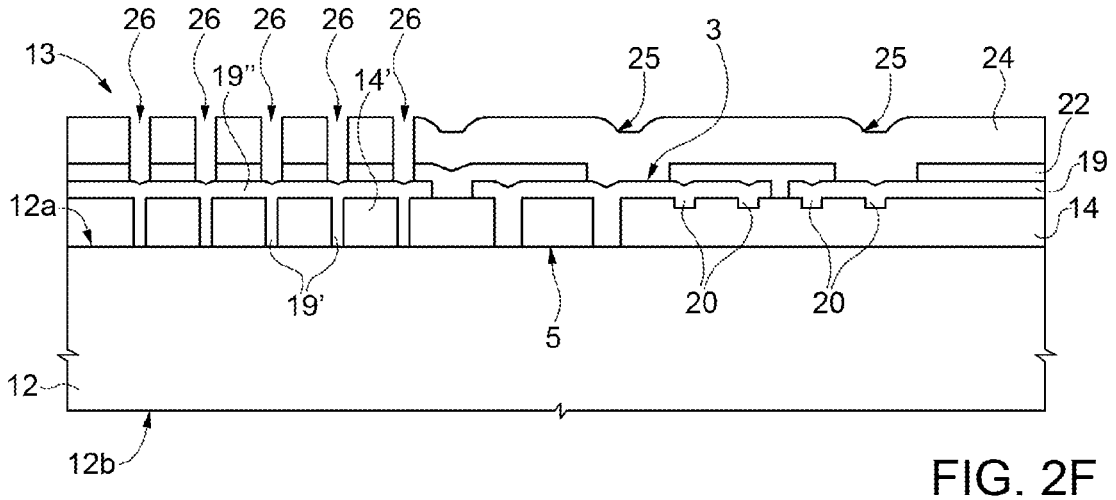

As shown in FIG. 2*f* envisages, according to one aspect of the present solution, definition of the third sacrificial layer 24 and of the underlying second sacrificial layer 22 in an area corresponding to what will become the anchorage structure of the rigid plate.

In particular, by means of a chemical etching with etch-stop on the first conductive layer 19, second plate-anchorage openings 26 are formed, which are arranged vertically in a position corresponding to the position previously assumed by the first plate-anchorage openings 18, and have a width, in the horizontal plane xy, greater than, or equal to, the width previously assumed by the same first plate-anchorage openings 18.

Figure 2G:
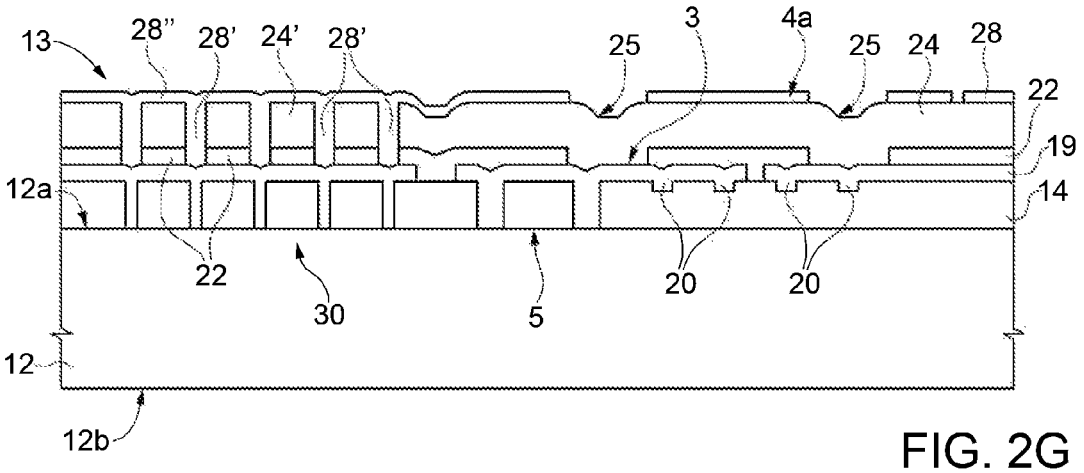

As shown in FIG. 2*g* a second conductive layer 28, for example made of polysilicon with a thickness of 0.9 μm, is deposited on the wafer 13.

The second conductive layer 28 is then selectively removed by chemical etching with etch-stop on the underlying second sacrificial layer 24 in order to expose the depressions 25 in the same second sacrificial layer 24. The remaining portions of the second conductive layer 28, arranged above the membrane 3, are designed to form the first plate layer 4*a* of what will be the rigid plate 4 of the micromechanical detection structure.

Furthermore, the second conductive layer 28, in an area corresponding to the anchorage structure of the rigid plate 4, fills the second plate-anchorage openings 26, coming into contact with the underlying portions of the first conductive layer 19.

The top portion of the anchorage structure of the rigid plate 4 of the acoustic transducer is thus formed, here designated as a whole by 30.

This top portion comprises: vertical portions 28' of the second conductive layer 28, formed within the second plate-anchorage openings 26; the residual portions 22', 24' set on top of one another of the second and third sacrificial layers 22, 24 between adjacent vertical portions 28'; and the overlying horizontal portions 28" of the second conductive layer 28 (which are joined to the aforesaid vertical portions 28'). In particular, the vertical portions 28' hence constitute prolongations of the first plate layer 4*a* of the rigid plate 4, being integral with the rigid plate 4 itself at an edge portion thereof. These vertical portions 28' terminate at a distance from the front surface 12*a* of the substrate 12, in particular at a distance comparable (i.e., substantially equivalent) to the height in the vertical direction of the same vertical portions 28'.

Figure 2H:
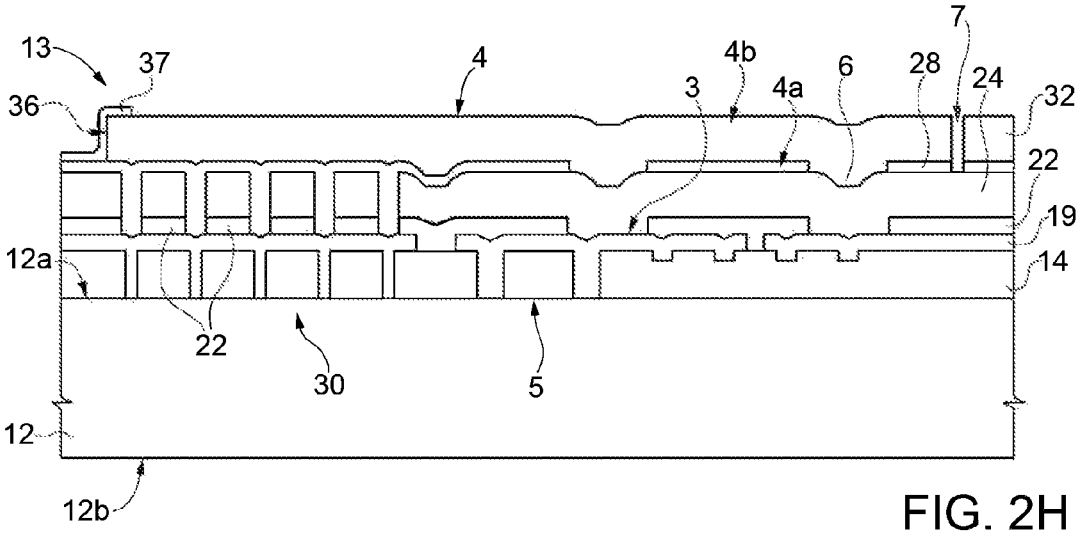

As shown in FIG. 2*h*, a passivation layer 32 is deposited on the wafer 13, for example by LPCVD (low-pressure chemical vapor deposition), made of insulating material, for example silicon nitride, with a thickness, for example, of 2 μm.

The passivation layer 32 is hence deposited on the second conductive layer 28 to form the second plate layer 4*b* of the rigid plate 4 and fills, in particular, the depressions 25, thus forming the bumps 6 of the rigid plate 4, which extend towards the underlying membrane 3 with anti-adhesion function.

The passivation layer 32 moreover extends above the anchorage structure 30, by which it is supported at the same level (with respect to the horizontal plane xy) as the rigid plate 4.

A subsequent etching step of the passivation layer 32 and of the underlying second conductive layer 28, with etch-stop on the third sacrificial layer 24, provides formation of the holes 7, which traverse the entire thickness of the rigid plate 4. As previously mentioned, holes 7 may be arranged to form a lattice in the horizontal plane xy.

Furthermore, a further etching step (by means of a further lithographic step) for etching the passivation layer 32, with etch-stop on the underlying second conductive layer 28, enables formation of at least one contact opening 36 through the passivation layer 32, laterally with respect to the underlying anchorage structure 30.

As shown in the same FIG. 2*h*, at least one contact pad 37 is formed within the contact opening 36, in electrical contact with the second conductive layer 28 and hence with the rigid plate 4 of the micromechanical detection structure of the acoustic transducer.

The contact pad 37 is, for example, made of gold, by means of the cathode-sputtering technique.

Figure 2I:
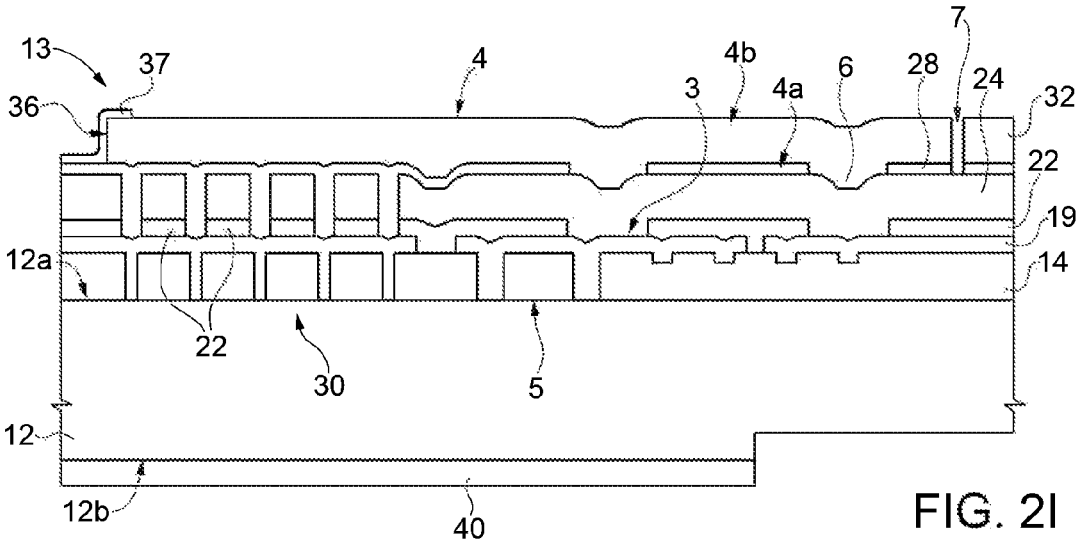

As shown in FIG. 2*i*, a step of machining of the back of the wafer 13 is carried out.

In particular, by means of successive steps of etching and mechanical polishing (the so-called "grinding" operation), the back of the wafer 13 (at the back surface 12*b* of the substrate 12) is polished and thinned until a thickness of, for example, 400 μm is reached. To protect the front of the wafer 13 during these steps of polishing and thinning, it may be advantageous to deposit a protective layer (not shown), which is then removed.

By means of successive lithography and etching steps, the first cavity 9*a* of the micromechanical structure 10 of the acoustic transducer is then formed, in particular, using a double dry etching.

First, a layer of TEOS oxide is grown on the back of the wafer 13 and is defined to form first mask regions 40, by etching with etch-stop on the underlying substrate 12.

This is followed by a first deep dry etch of the substrate 12, starting from the back surface 12*b*.

The area of the substrate 12 subjected to etching is defined by the first mask regions 40, whereas the depth of the portion of substrate 12 etched is equal to the depth that it is desired to obtain for the first cavity portion 9*a'*.

Figure 2J:
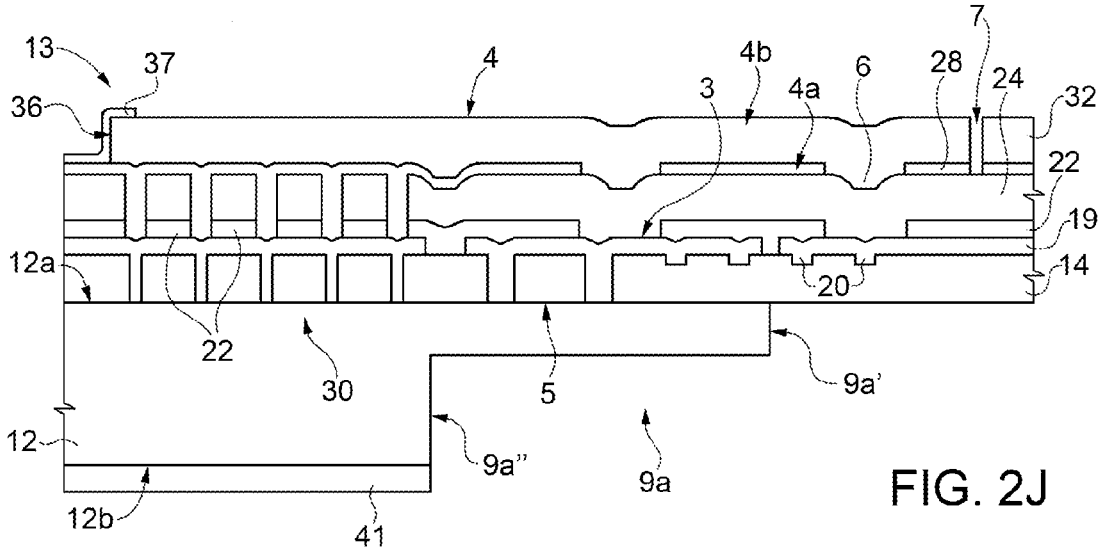

As shown in FIG. 2*j*, the first mask regions 40 are partially removed to form second mask regions 41 that define the area of the second cavity portion 9*a*', with an amplitude greater than the area of the first cavity portion 9*a*'. In particular, a second deep dry etching on the back of the wafer 13 with etch-stop on the first sacrificial layer 14 allows removal of the substrate 12 in an area corresponding to the first cavity 9*a*', partially exposing the first sacrificial layer 14; at the same time, the second cavity portion 9*a*' is formed. The first cavity portion 9*a*' may, for example, have in plan view a circular or square shape, and the second cavity portion 9*a*' a generically square shape.

The second mask portions 41 are then removed.

Figure 2K:
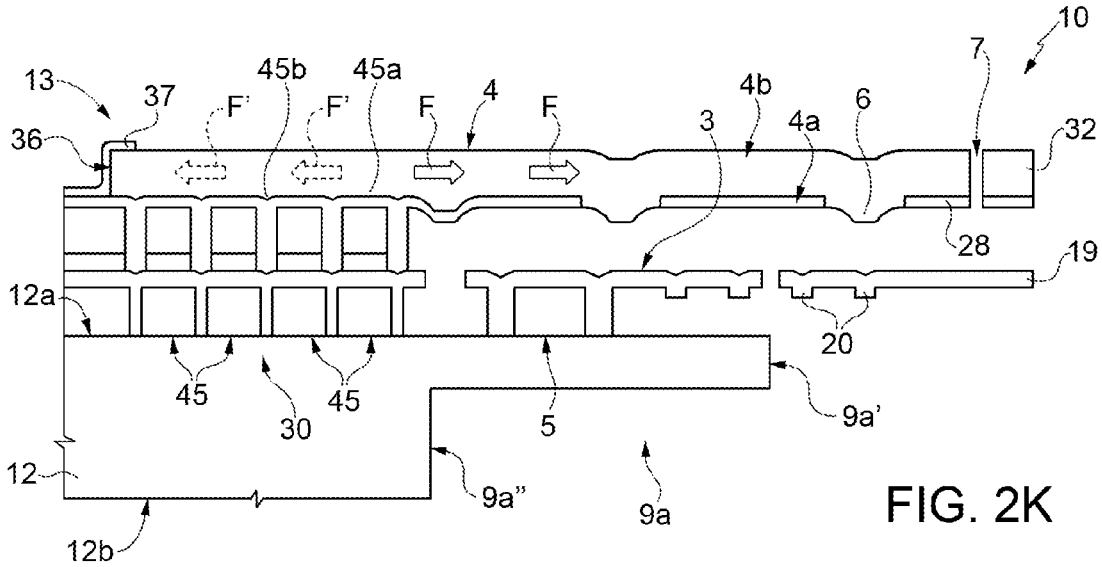

As shown in FIG. 2*k*, the wafer 13 is subjected to a wet etching, for example with hydrofluoric acid (HF), to remove the first, second, and third sacrificial layers 14, 22 and 24, where they are not protected, thus defining the resulting micromechanical structure, designated as a whole by 10, of the acoustic transducer, and in particular releasing the membrane 3, which is suspended over the first cavity 9*a*, and the rigid plate 4, which is separated from the same membrane 3 by a gap defined by the second cavity 9*b*.

It should be noted that, during the aforesaid etching step, the anchorage structure 30 operates like a sort of a dyke, which is not involved by the wet etching. In particular, due to the presence of the vertical portions 19', 28' of the first and second conductive layers 19, 28, the portions of the sacrificial layers inside the anchorage structure 30 itself are not removed.

In the resulting micromechanical structure 10, the rigid plate 4 is coupled to the substrate 12 by means of the anchorage structure 30, which hence comprises a plurality of pillar elements 45, each formed by stacked portions of the first, second, and third sacrificial layers 14, 22 and 24 and by the horizontal portions 19", 28" of the first and second conductive layers 19, 28 (which together constitute a body portion 45*a* of each pillar element 45). Adjacent pillar elements 45 are separated laterally by the vertical portions 19', 28' of the first and second conductive layers 19, 28 (which, being stacked in a vertical direction, together constitute wall portions 45*b* of the pillar elements 45).

In particular, as previously mentioned, the wall portions 45*b* of the pillar elements 45 have a protection and confinement function with respect to the body portions 45*a* of the same pillar elements 45, during the wet etching step leading to removal of the sacrificial regions, where they are not protected.

As is evident from what has been illustrated in FIG. 3, the anchorage structure 30 surrounds the membrane 3 entirely, and each pillar element 45 defines a closed perimeter, of a substantially polygonal shape in plan view, around the same membrane 3. In particular, the pillar elements 45 are set side-by-side in the horizontal plane xy and each defines a perimeter that is, for example, substantially square (but for projections set at the vertices of the square and extending along the diagonals of the square itself).

As shown schematically in the aforesaid FIG. 2*k*, the presence of the anchorage structure 30 induces in the rigid plate 4 of the micromechanical structure 10 a compensation force, designated by F' and acting in the horizontal plane xy, which counters the bending force F, which is generated in the rigid plate 4 itself on account of the residual stresses in the constituent materials. The anchorage structure 30 hence supports the rigid plate 4 in the horizontal plane xy, preventing, or in any case reducing, its deformation and keeping the rigid plate itself substantially parallel to the front surface 12*a* of the substrate 12 and to the horizontal plane xy.

Figure 2L:
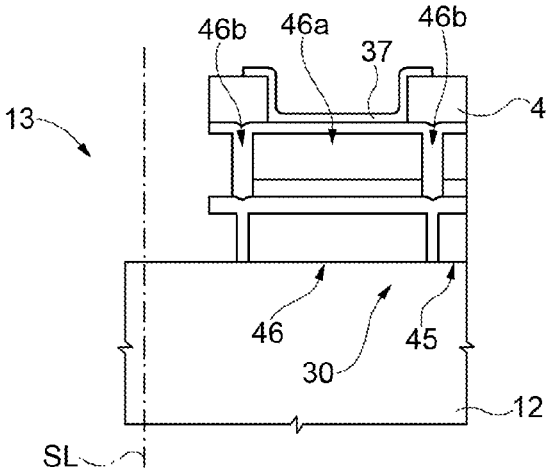

FIG. 2*l* shows termination of the anchorage structure 30, at a scribe line SL of the wafer 13, along which the wafer 13 is subjected to dicing during the dicing steps for formation of dice starting from the same wafer.

In a possible embodiment, a termination pillar element 46 at the scribe line SL has a lateral extension that is greater (i.e., a greater extension of the corresponding body portion, designated by 46*a*) as compared to that of the pillar elements 45 of the anchorage structure 30, and supports the contact pad 37 at the top.

In any case, it is clear that the manufacturing steps described may be used for manufacturing a plurality of micromechanical detection structures 10 for corresponding acoustic transducers on one and the same wafer 13.

Figure 4:
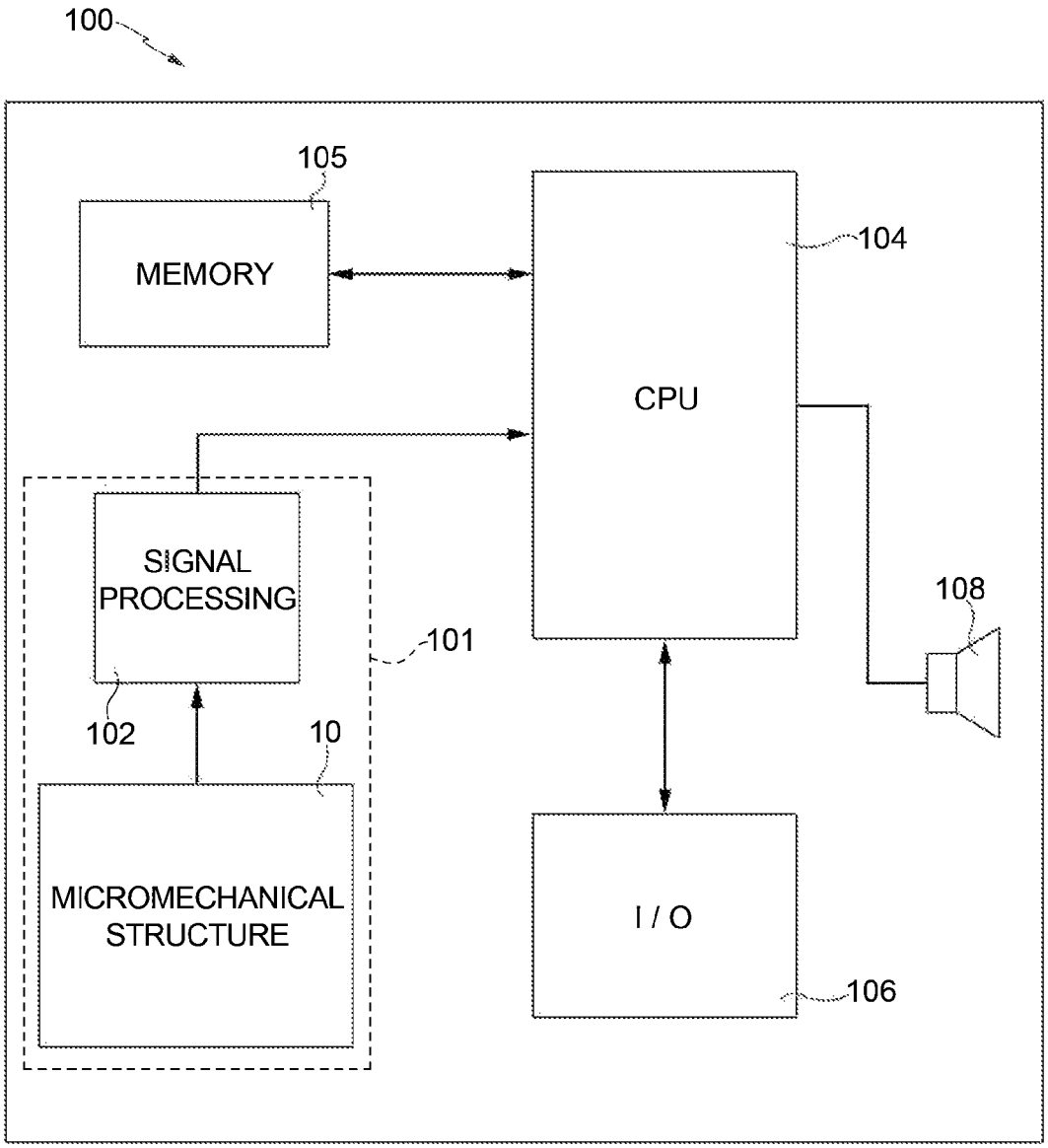
FIG. 4 is a block diagram of an electronic device including the MEMS acoustic transducer.

FIG. 4 shows an electronic device 100 that uses one or more MEMS acoustic transducers 101 (just one MEMS acoustic transducer 101 is shown in the figure), each comprising a micromechanical detection structure 10 and a corresponding electronic circuit 102 for processing the transduced electrical signals.

The electronic device 100 comprises, in addition to the MEMS acoustic transducer 101, a microprocessor 104, a memory block 105, connected to the microprocessor 104, and an input/output interface 106, for example including a keyboard and a display, which is also connected to the microprocessor 104. The MEMS acoustic transducer 101 communicates with the microprocessor 104 via the electronic circuit 102. Furthermore, a speaker 108 for generating sounds on an audio output (not shown) of the electronic device 100 may be present.

The electronic device 100 is preferably a mobile communication device, such as for example a mobile phone, a PDA, a notebook, but also a voice recorder, a reader of audio files with voice-recording capacity, etc. Alternatively, the electronic device 100 may be a hydrophone, capable of working under water. The electronic device may be a wearable device.

The advantages of the solution described emerge clearly from the foregoing discussion.

It is in any case once again emphasized that the particular anchorage structure 30 for the rigid plate 4 of the micromechanical detection structure 10 affords the dual advantage of: eliminating, or in any case markedly reducing, the bending stresses to which the rigid plate 4 is subjected, thus improving the electrical characteristics of the corresponding acoustic transducer 101; and simplifying the manufacturing process, given the greater "horizontality" of the micromechanical detection structure 10, and the absence of vertical elements that have to be coated with thick resist layers.

In particular, tests made by the present Applicant have shown that in the micromechanical structure 10 of the present solution the rigid plate 4 is subjected to deformations not greater than 0.2 μm, much less (in particular, by at least one order of magnitude) than the deformations present in traditional solutions, which have values in the region of a few microns.

Furthermore, the deformations in the micromechanical structure 10 of the present solution are altogether repeatable in different production lots, unlike traditional solutions, where the deformations vary even markedly in different production lots (being linked to the residual stresses in the materials, which are also markedly dependent upon the specific production lot).

Furthermore, the manufacturing process described does not involve additional process steps as compared to known solutions, only using different conformations of the lithography and chemical-etching masks that lead to definition of the various layers and levels of the micromechanical detection structure 10.

Finally, it is clear that modifications and variations may be made to what has been described and illustrated herein, without thereby departing from the scope of the present disclosure.

In particular, it is clear that the number of pillar elements 45, of which the anchorage structure 30 is made, may vary with respect to what has been illustrated, according to the specific requirements of the micromechanical structure 10. In this regard, by increasing the number of pillar elements 45 the resulting mechanical strength may be increased; moreover, the redundancy thus introduced would prove advantageous in the presence of defectiveness that would enable permeation of the wet etching in the internal area of the anchorage.

Furthermore, also the geometrical conformation of the anchorage structure 30 in the horizontal plane may possibly differ from what has been illustrated. In particular, in a position corresponding to the contact pads 37, the anchorage structure 30 may have a smaller number of pillar elements 45, for example just one pillar element 45 having a larger horizontal extension.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A micromechanical structure comprising:

a semiconductor substrate having a first surface;

an anchorage structure including a plurality of pillar elements separated from each other by a conductive material; and a detection capacitor including:

a membrane coupled to said substrate and configured to deform in response to acoustic-pressure waves; and a fixed electrode that is rigid with respect to said acoustic-pressure waves and is coupled to said substrate by the anchorage structure, the anchorage structure being configured to support the fixed electrode in a suspended position facing said membrane.

2. A micromechanical structure comprising:

a semiconductor substrate having a first surface;

an anchorage structure including a plurality of pillar elements; and a detection capacitor including:

a membrane coupled to said substrate and configured to deform in response to acoustic-pressure waves; and a fixed electrode that is rigid with respect to said acoustic-pressure waves and is coupled to said substrate by the anchorage structure, the anchorage structure being configured to support the fixed electrode in a suspended position facing said membrane a rigid plate coupling the fixed electrode to the anchorage structure, the fixed electrode including a conductive layer facing said membrane; and wherein said plurality of pillar elements include a same material as the conductive layer, and at least some of the pillar elements including prolongations that extend in a direction that is transverse with respect to said first surface of the substrate and terminate at a distance from said first surface of said substrate.

3. The structure according to claim 1, wherein said plurality of pillar elements together form a closed perimeter that surrounds said membrane.

4. The structure according to claim 2, wherein said anchorage structure is configured to exert on said fixed electrode a compensation force that compensates for a deformation force applied to said fixed electrode.

5. The structure according to claim 1, further comprising a rigid plate coupling the electrode to the anchorage structure, wherein each pillar element comprises:

wall portions that extend transversely with respect to said first surface of said substrate and include the conductive material; and a body portion enclosed between said wall portions, said rigid plate extending over said body portion.

6. The structure according to claim 5, wherein each pillar element includes insulative material and conductive material.

7. The structure according to claim 5, wherein:

said rigid plate includes a conductive layer having prolongations that extend from said rigid plate forming a top part of said wall portions; and said wall portions have a bottom part that are distinct from said prolongations, the bottom part extending between the first surface of said substrate and said prolongations.

8. The structure according to claim 1, wherein each of said plurality of pillar elements includes a conductive portion and an insulative portion surrounded by the conductive material.

9. The structure according to claim 8 wherein two adjacent pillar elements share the same insulative portion.

10. The structure according to claim 1, wherein:

said fixed electrode comprises a conductive layer facing said membrane and an insulating layer located over said conductive layer; and said insulating layer couples said conductive layer to said anchorage structure.

11. A process for manufacturing a micromechanical structure, the process comprising:

forming a detection capacitor by:

forming a membrane coupled to a first surface of a semiconductor substrate, the membrane being configured to deform in response to acoustic-pressure waves;

forming a fixed electrode that is rigid with respect to said acoustic-pressure waves and is located in a suspended position facing said membrane; and forming an anchorage structure that includes a plurality of pillar elements and a conductive material, the anchorage structure coupling said fixed electrode to said substrate, and wherein said conductive material of said anchorage structure is distinct from said fixed electrode and separates the plurality of pillar elements from each other, and wherein said anchorage structure is configured to support said fixed electrode parallel to said first surface of the substrate.

12. The process according to claim 11, wherein forming the membrane comprises:

forming a first conductive layer above a first sacrificial layer that is located above said first surface of said substrate; and forming said membrane by removing an underlying portion of said first sacrificial layer, and wherein forming the anchorage structure comprises:

forming a plurality of first openings in the sacrificial layer; and filling said plurality of first openings while forming said first conductive layer of the conductive material and forming a bottom part of wall portions of said pillar elements.

13. The process according to claim 12, wherein said forming a fixed electrode comprises:

forming a second conductive layer above a second sacrificial layer located over said first conductive layer; and releasing said fixed electrode portion by removing an underlying portion of said second sacrificial layer, and wherein said forming the anchorage structure further comprises:

forming a plurality of second openings in said second sacrificial layer; and filling said plurality of second openings while forming said second conductive layer.

14. The process according to claim 13, wherein said second conductive layer that fills the plurality of second openings is the same material that is used to form the fixed electrode.

15. The process according to claim 11, wherein:

said steps of forming the membrane and forming the fixed electrode comprise a common step of removing layers of sacrificial material; and said anchorage structure includes a plurality of pillar elements, each including wall portions of the conductive material that extend in a first direction that is transverse with respect to said first surface of said substrate and a body portion that is enclosed between said wall portions, said body portion including sacrificial material that is removable by chemical etching, and said wall portions forming the conductive portion that is insensitive to said chemical etching.

16. The process according to claim 11, wherein said pillar elements form a closed perimeter that surrounds said membrane.

17. The process according to claim 11, wherein forming said anchorage structure comprises forming a plurality of pillar elements coupled to the first surface of the substrate.

18. An electronic device comprising:

a microprocessor; and a micromechanical structure coupled to the microprocessor, the micromechanical structure including:

a semiconductor substrate having a first surface;

an anchorage structure that includes a plurality of pillar elements that include a conductive portion and an insulating portion, each of the pillar elements being separated from each other by conductive material;

a detection capacitor:

a membrane flexibly coupled to the semiconductor substrate and configured to deform in response to pressure; and a rigid plate that includes a fixed electrode spaced apart from the membrane, the rigid plate being fixedly coupled to the semiconductor substrate by the anchorage structure, the fixed electrode being electrically isolated from the pillar elements of the anchorage structure.

19. The electronic device according to claim 18, wherein the anchorage structure extends around the entire perimeter of the membrane.

20. The electronic device according to claim 18, wherein the conductive portion of the pillar elements include two layers of conductive material and the insulating portion of the pillar elements include at least two layers of insulating material.

21. The electronic device according to claim 18, wherein the electronic device is at least one of a mobile phone, a PDA, a notebook, a voice recorder, a reader of audio files with voice-recording capacity, a hydrophone, and a wearable device.

22. The electronic device according to claim 18, wherein the conductive portion of the pillar elements is of a same conductive material as the fixed electrode.

* * * * *